US005573147A

United States Patent [19]

Nilsson et al.

[11] Patent Number: 5,573,147

[45] Date of Patent: Nov. 12, 1996

[54] CONTAINER IN COMBINATION WITH A REMOVABLE CAP

[76] Inventors: Hugo Nilsson, Gunstorp, Tutaryd, S-341 96 Ljungby; Karl-Eric Johnsson, Åby, S-340 14 Lagan, both of Sweden

[21] Appl. No.: 374,760

[22] PCT Filed: Aug. 12, 1993

[86] PCT No.: PCT/SE93/00677

§ 371 Date: Jan. 27, 1995

§ 102(e) Date: Jan. 27, 1995

[87] PCT Pub. No.: WO94/04422

PCT Pub. Date: Mar. 3, 1994

[30] Foreign Application Priority Data

Aug. 12, 1992 [SE] Sweden ..... 9202342

[51] Int. Cl.[6] ..... B65D 88/54

[52] U.S. Cl. ..... 222/327; 222/386

[58] Field of Search ..... 222/327, 386, 222/570

[56] References Cited

U.S. PATENT DOCUMENTS 3,200,986 8/1965 La Grutta .
3,297,193 1/1967 Stevens, Jr. .
3,392,873 7/1968 Old, Jr. .
3,743,131 7/1973 Croyle et al. .
4,307,817 12/1981 Cotroneo .
4,640,435 2/1987 Dutt .
5,137,184 8/1992 Jackson et al. .

FOREIGN PATENT DOCUMENTS 1304563 1/1973 United Kingdom .

*Primary Examiner*—Gregory L. Huson
*Attorney, Agent, or Firm*—Davis and Bujold

[57] ABSTRACT

A container (1) for a lubricant has a cap (2) for sealing off one end (4) of a cylindrical tube (2). The cap (2) shows a bottom (19), from the periphery of which extends in an axial direction a circumferential interior ring part (17), which faces the inside of said tube end (4). The cap (3) rests, with a radially extended ring part (16) connected to said interior ring part (17), upon a radial end surface of said tube end (4). According to the invention, the latter end shows a circumferential flange edge pointed obliquely inwardly towards the central part of the tube (2) and being intended to act upon an exterior circumferential bulge (24) on the outside of cap wall (17). For optimal insertion into the tube (2) and passing said edge (18), said bulge (24) downwardly forms a longer bevel (24) with a minor style in relation to said wall (17), while for optimal locking, said bulge (24) is upwardly more acutely rounded close to said lateral wall (17).

20 Claims, 5 Drawing Sheets

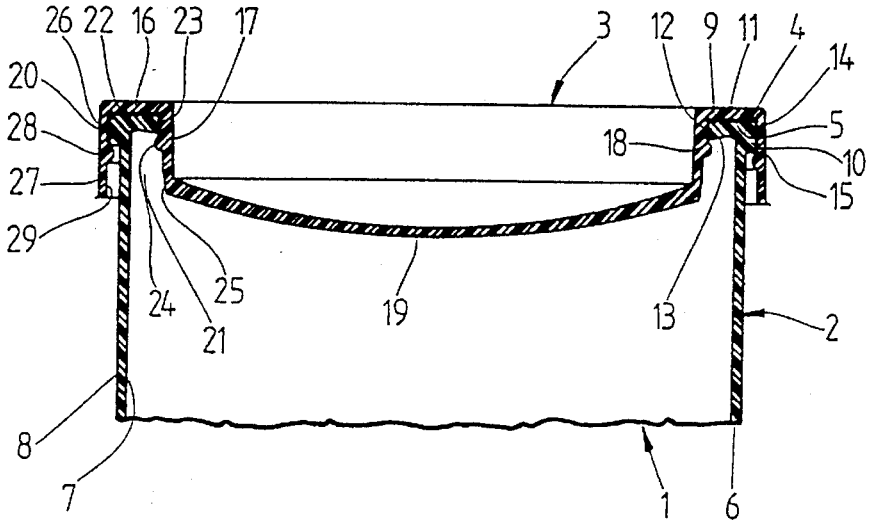
FIG. 2
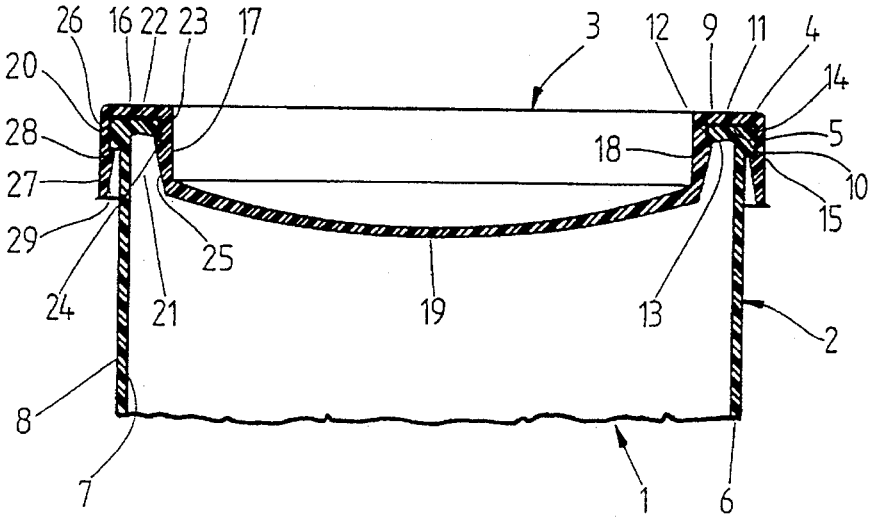
FIG. 3
FIG. 4
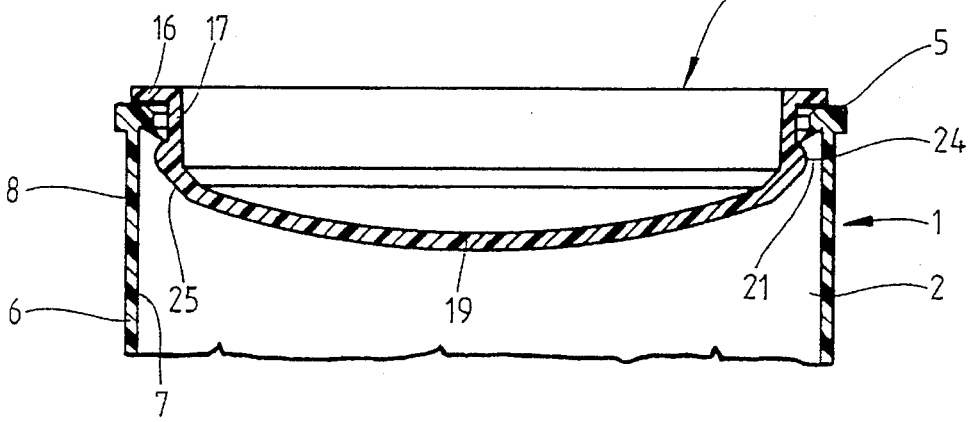

5
9
11
56
14
12
10
55
15
18
13
8
7
6

5
8
2
30
43

5
6
7
8
2
30
43
51

FIG. 11
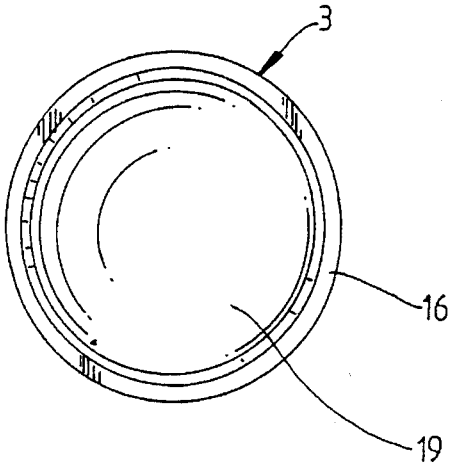
FIG. 14
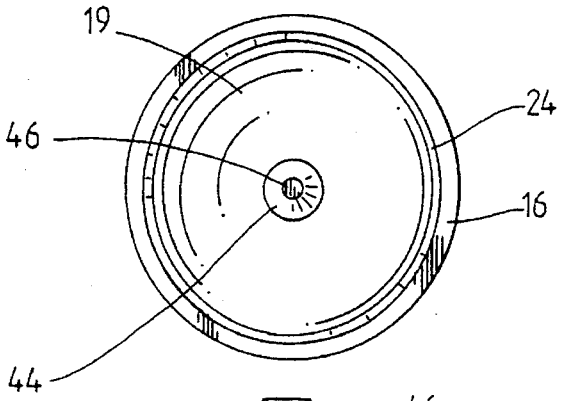
FIG. 12
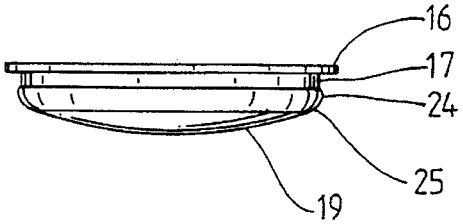
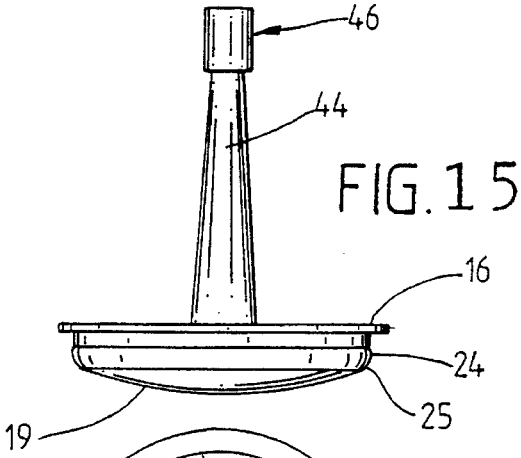
FIG. 15
FIG. 13
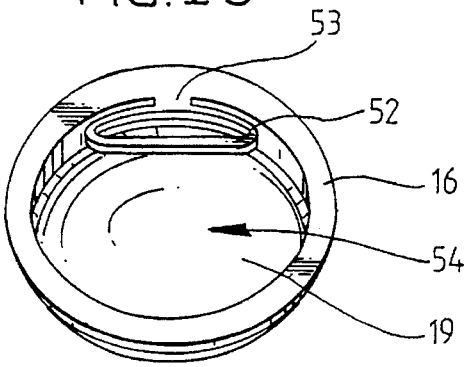
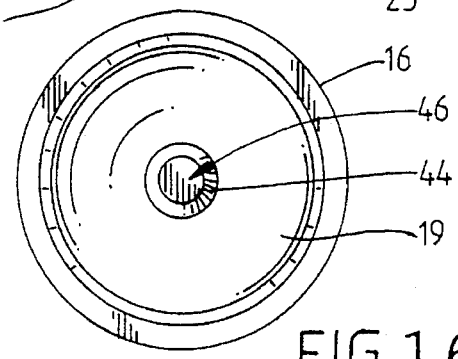
FIG. 16
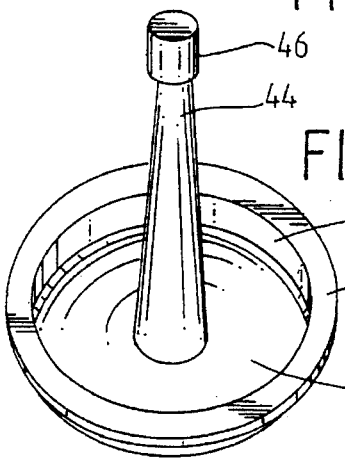
FIG. 17

CONTAINER IN COMBINATION WITH A REMOVABLE CAP

BACKGROUND OF THE INVENTION

The present invention relates to a container with at least one closure means according to the preamble of claim 1.

The invention is particularly concerned with lubricant cartridges and caps for sealing same.

Today, consciousness towards the environment is greater than in the past and containers must fulfill high safety demands, particularly for substances which are detrimental to the environment.

Nevertheless, such containers should be simple and easy to produce at low costs and their handling should also be easy and simple, both as to filling, preferably fully automatic sealing as well as repeated sealing at great and maintained safety, even after repeated opening and closing operations. The closure means should even be able to resist outer and interior strain up to a certain level, so that leakage may be avoided with comparatively great security. Furthermore, the contents of such a container must be fed out in a simple and reliable way.

The previously known containers and their closure means do not fulfill these demands, at least not in combination.

Caps which are previously known in this technical field, serve as sealing means for a cartridge or the like between its filling and use. When using the cartridge, the cap is normally removed and thrown away and has, therefore no further function to fulfill.

Beyond this limited function, previously known caps suffer often from the drawback, that they do not seal the container sufficiently safely. Leakage may thus occur easily and frequently and often a full container and maybe even adjacent containers, the contents of which has leaked out, are thrown away, as it can be rather unpleasant to get hands, clothes etc polluted.

Apart from possible leakage, the previously known caps are nevertheless hard to remove, particularly caps which are not designed as screwcaps. If the caps are designed as screwcaps, i.a. increased material thickness is required as well as extra means to provide the cap with interior threads and furthermore extra means to provide the one cartridge end with outer threads.

SUMMARY OF THE INVENTION

One objective of the present invention is therefore to provide an advantageous container with at least one likewise advantageous closure means which, avoiding or counteracting the above-mentioned drawbacks, fulfills the above-mentioned demands in combination.

Another objective of the invention is to improve previously known containers and their closure means in various respects, particularly as to facilitating application of caps, guarantee the applied position of the caps in spite of considerable outer and/or interior strain, such as pressure, and to make possible a fast, easy and simple removal of said caps when so desired.

Furthermore, there should be material saving and great safety against undesired separation. Furthermore, there should be a positive effect on both separability and subsequent guiding, control and sealing, and the container as such should be designed to further such properties in a far-reaching way, whereby e.g. tolerances, shrinking etc shall be controlled.

These objectives are achieved according to the invention by a container and at least one closure means, respectively, of the initially described kind.

BRIEF DESCRIPTION OF THE DRAWINGS

Further characteristics of and advantages with the invention are revealed by the following detailed specification with reference to the accompanying drawings, which in a partly schematic way show preferred embodiments. In the drawings:

FIG. 2 is a partial diametrical axial sectional view of a second embodiment of a closure means according to the invention similar to the one of FIG. 1 but with a modified cap, FIG. 3 is a partial diametrical axial sectional view of a circular cylindrical tube according to the invention sealed at the one end by a cap similar to the one shown in FIG. 2, FIG. 4 is a magnified cross-sectional view of the upper end of a container as shown in FIG. 7 and a cap as shown in FIG. 21, FIGS. 14–17 show the spout cap of FIG. 10 seen from below, from the side, from above and in a perspective from above.

DESCRIPTION OF THE PREFERRED EMBODIMENTS

Figure 5:
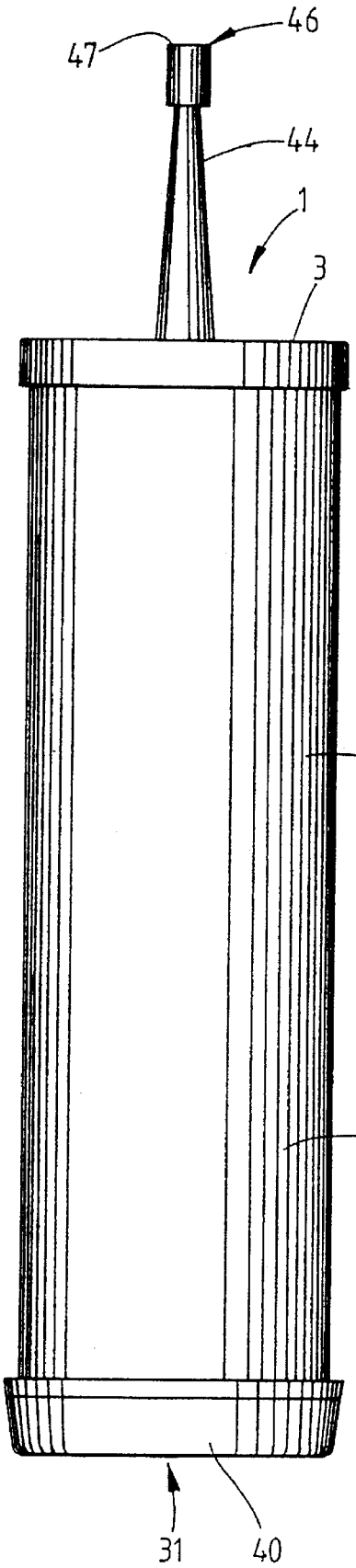
FIG. 5 is a side elevational view of the container shown in FIG. 1.

A container according to the invention is designated in its entirety by 1. This container comprises a preferably circular cylindric tube 2, which preferably is made of plastic material by injection molding. The other part of the container, which is optional, is a cap 3, which is at least partially matching in shape. The tube is preferably made of polyethylene HD 7028 and the cap of polyethylene LD+HD.

Characterizing for the tube 2 may be a flange 5, which preferably surrounds the one tube end 4. In accordance with a preferred embodiment, this flange extends radially both inwardly and outwardly from the respective cylindrical surfaces 7 and 8 of the tube wall 6 to form an interior flange 9 and an exterior flange 10.

In accordance with a preferred embodiment, the interior flange 9 projects longer from the adjacent cylindrical surface 7 than the outer flange 10 does from its adjacent surface 9. Typically, the interior flange may project 1–3 mm, preferably app. 2 mm, while the exterior flange may project 0.5–2.5 mm, preferably app. 1 mm. This makes the interior flange creating a greater retaining force in relation to the cap 3 than the exterior flange. In this way, a cap attached to the tube may resist comparatively great strain, particularly such strain which arises when the contents of the container is subjected to squeezing propagating a pressure on the cap from the inside, e.g. when a tube falls down or is harshly grasped. At the same time, it is nevertheless relatively easy to remove the cap e.g. temporarily, as for this the free exterior edge of the cap outside the tube is grasped and heeled over and away from tube end 4 with the radially shorter exterior flange offering less resistance.

The interior flange 9 and the exterior flange 10 do suitably share a common upper delimitation surface 11 forming the free axial end surface of tube end 4.

In accordance with a preferred embodiment, the interior flange 9 is shorter in axial direction than the exterior flange 10. Typically, the interior flange can be 1–3, preferably approximately 2 mm long, while the exterior flange can measure 2–4, preferably approximately 2.5 mm in axial direction, whereby an interior sealing surface 12 and an exterior sealing surface 14 are formed, which preferably are situated within cylindrical, mutually coaxial surfaces. While the exterior flange 10 is terminated at its axial end which is turned away from surface 11 by a shoulder 15, which is preferably situated within a radial plane, the interior flange is terminated within a corresponding region preferably as an undercut surface 13, which may be straight or concave to form a pointed annular edge 18, the purpose of which is to exert an extra sealing effect in relation to cap 3. The angle included between surfaces 12 and 13 amounts to 30°–85°, preferably approximately 70°. Even another angle than 90° between surfaces 11 and 12 is conceivable, namely a larger angle than 90°, e.g. 90°–130°, preferably app. 110°. It is also possible to provide at the outer part of surface 12 a bevel or curve to facilitate pushing of a cap onto the tube.

The cap 3 itself is partially matching the shape of tube end 4 as shown and described. Accordingly, the cap shows situated within a radial plane, a ring part 16, which inwardly connects to a circular cylindric ring part 17, which is closed by a bottom 19, which preferably is slightly concave seen from outside. These three parts 16, 17 and 19 show e.g. app. same material thickness, e.g. app. 1 mm. Outwardly, ring part 16 connects to an outer circular cylindric ring part 20, which is equally long as or somewhat longer in axial direction than the interior ring part 17, measured from ring part 16.

Parts 16, 17 and 20 define an annular groove 21 for receiving and arresting tube end 4. To this purpose, parts 17 and 20 are provided with circumferential shoulders, bulges or the like 24 and 28, respectively, which are facing each other but are offset somewhat in axial direction in relation to one another corresponding to the previously described and shown difference in axial extension between interior and exterior flange. With a cap firmly applied, said shoulders, bulges or the like 24 and 28 are provided directly below surfaces 13 and 15, so that the cap may not be removed without considerable stretching away from tube end 4.

The free axial half 27 of ring part 20 may optionally be bent outwardly somewhat or provided with a circumferential interior bevel 29 for facilitating pushing the cap onto the tube end. For the same purpose, that half of ring part 17, which connects to bottom 19, may be provided with a bevel 25.

As the outer ring part 20 does not have to develop similar resistance properties as to unintended release of the cap and the cap furthermore to a certain extent should be removable intentionally, this ring part is suitably shaped somewhat thinner, e.g. 0.7 mm thick, while the other two parts and even the bottom may be shaped app. 1 mm thick, all in accordance with one non-limiting embodiment.

Beyond the effects described hereinbefore, the closure means according to the invention is characterized by following properties. In the normal sealed position according to FIG. 1, excellent sealing is achieved around the entire periphery of both inside, endside and outside of the tube. If so desired, ring groove 21 may be furnished with a sealing agent, e.g. silicon, in connection with the filling and sealing of the tube at a factory. In this way, extra great safety against leakage during handling onward to the user is achieved.

If a filled tube sealed by a cap as described and shown is exposed to interior pressure for a reason as described before, such pressure will affect primarily the cap bottom, which is pushed upwards to attain a more flat shape, whereby ring part 17 is pressed against or towards the tube wall within the connecting region between this part and the bottom and will increase the sealing pressure of the shoulder, bulge or the like 24 against and around ring edge 18. The pointed shape of the latter guarantees in a far-reaching way, that the cap may not be released at minor or medium size pressures from the inside.

When applying pressure from the outside on e.g. the cap bottom in axial direction, parts 16 and 20 and particularly the shoulder, bulge or the like 28 will resist such pressures to a practically unlimited extent. The shoulder, bulge or the like 28 functions here as some kind of heeling stop, which prevents in combination with shoulder 15, that the peripheral channel part of the cap may "glide" inwardly around tube end 4.

On the other hand, if it is desired to remove the cap, possibly only temporarily, this may be achieved comparatively simply and easily by grasping from outside the cap part 27 at any place and pulling and bending that place upwardly in FIG. 2, so that the shoulder, bulge or the like 28 may pass beyond shoulder 15. This is facilitated by shaping ring part 20 somewhat thinner in combination with manufacturing the cap in general of flexible plastic material and/or of material which is less flexible per se but flexible due to material thickness chosen. At continued pulling away of the cap, the shoulder, bulge or the like 24 glides along and eventually beyond ring edge 18, until the cap is entirely removed.

If desired to seal the tube again, the cap is attached loosely to tube end 4 and is then pushed until the shoulders or bulges of the cap have glided past the shoulders of the tube end, with elastically deforming the cap parts concerned and eventually have snapped behind the tube shoulders or bulges and arrest the cap in this position.

Figure 1:
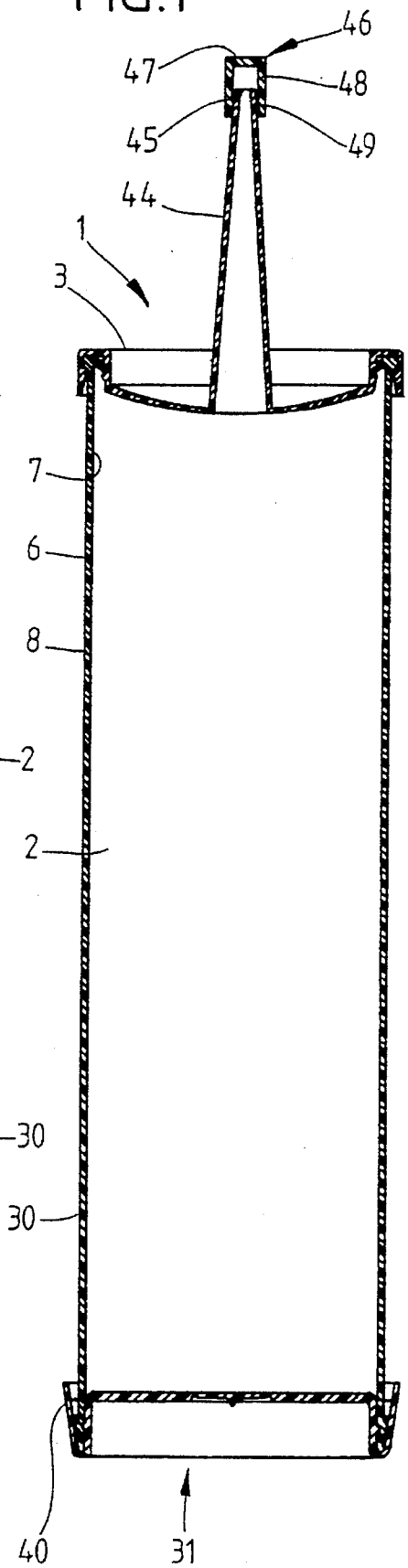
FIG. 1 is a diametrical axial sectional view of a first embodiment of a container according to the invention consisting of circular cylindric tube and two caps sealing same.
Figures 6, 7, 8:
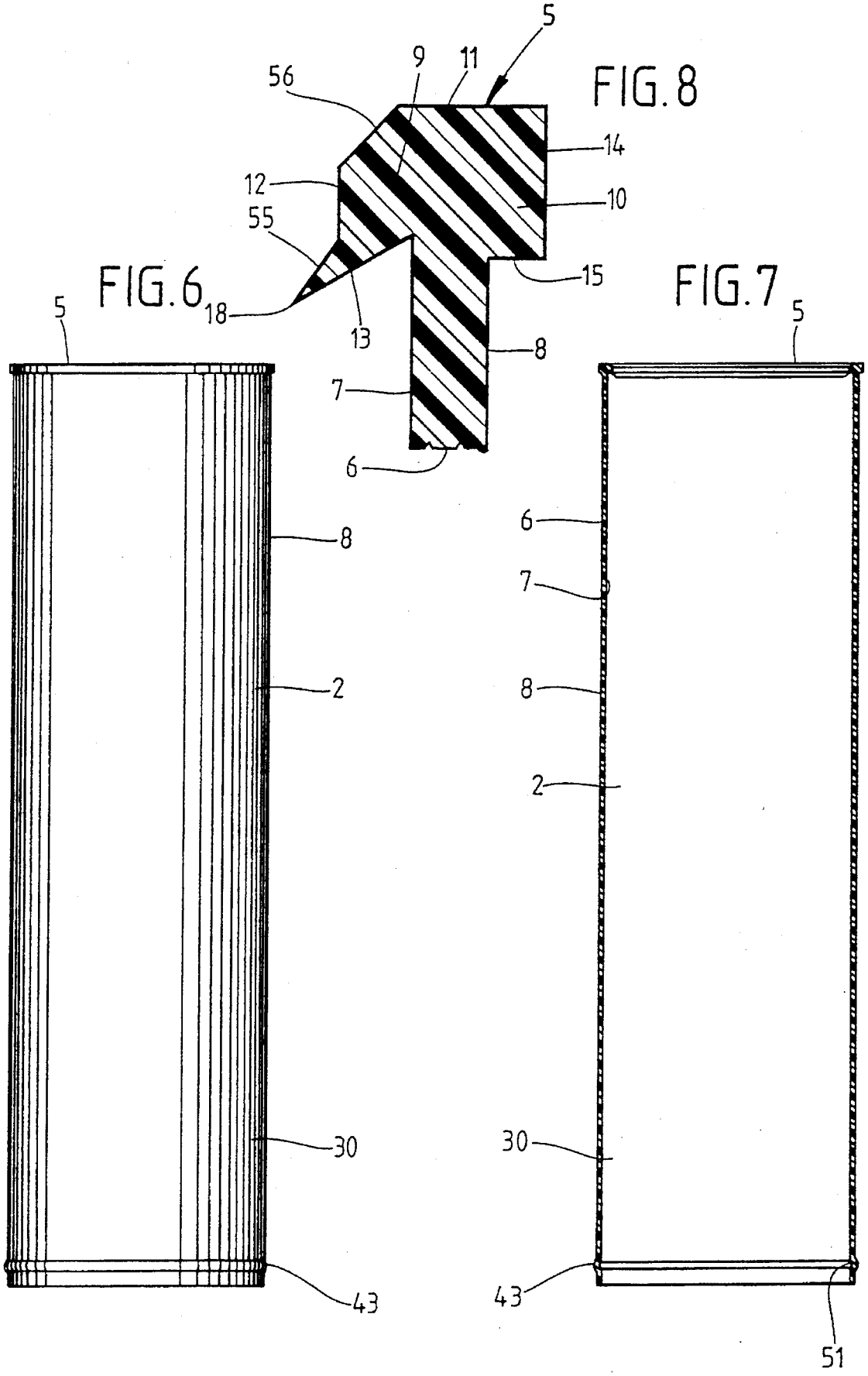
FIG. 6 is a side elevational view of the tube shown in FIGS. 1 and 5.
FIG. 7 is a diametrical axial sectional view of a tube shown in FIGS. 1, 5 and 6.
FIG. 8 is a magnified sectional view of the one end profile of a tube according to FIG. 7.

As can be seen, the embodiment according to FIGS. 1 and 2 differs from the one shown in FIG. 3 only in that the shoulders 24 and 28 have been replaced by bulges and by shaping the bevels 25 and 29 in a more reduced way.

FIGS. 3 shows an at least principally preferred embodiment of a tube according to the invention provided with two different closure means, one at each end. The one cap and the one tube end are suitably identically with or similar to the upper part of FIG. 1 or FIG. 2, while the other closure means differs there from and is designated in its entirety by 30. The latter means comprises a cap 31 having a preferably flat bottom 32 which substantially fills the interior of the tube. Outside of said tube end, cap 31 shows an exterior collar 40 abutting said tube end from the outside and showing, app. in the middle of its axial extent, an annular bulge abutting said tube end and being provided to grasp around and beyond an annular bulge 43 at this tube end, which latter bulge in its turn forms an annular groove 51 on the inside of the tube, into which interior groove the interior collar 36 is inserted with a circumferential bulge. The free end part of the exterior collar 40 may be bent somewhat outwardly and/or form an interior bevel for facilitating pushing of the cap onto this tube end.

The spout 44 according to FIGS. 1, 5, 9, 10 and 15–17 may be an outwardly conically converging pipe having an annular bulge 45 at its free end, which bulge is intended to be surrounded by a small cap 46 with a bottom 47 and a sleeve wall 48, on the inside of which there is an interior annular bulge 49. The spout is preferably integrated with the cap according to FIGS. 2, 3, 9, 10 or 14–17.

Figure 9:
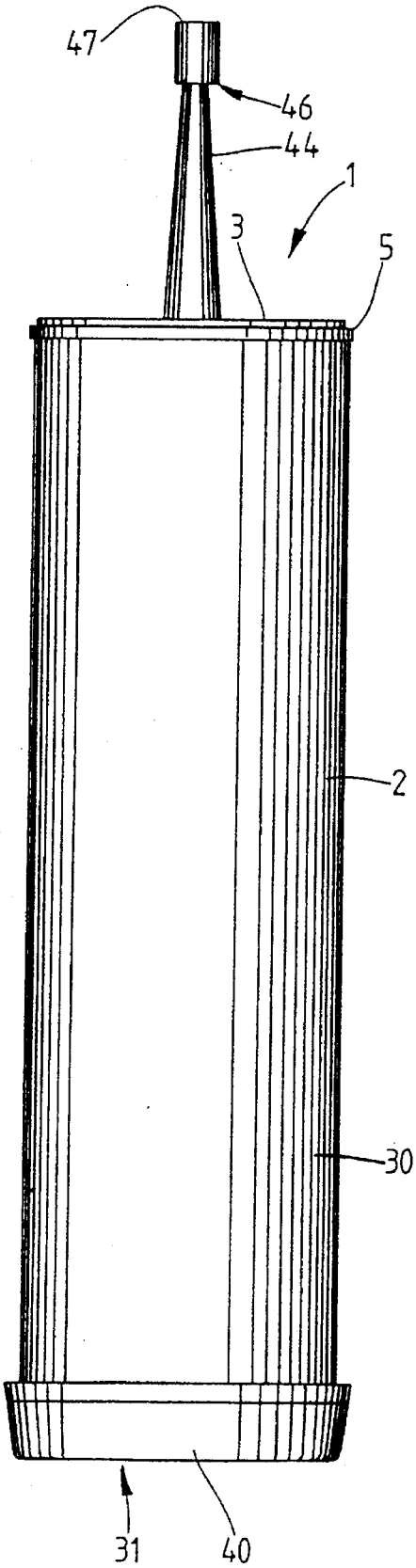
FIG. 9 is a side elevational view similar to the one of FIG. 5 of a modified embodiment.
Figure 10:
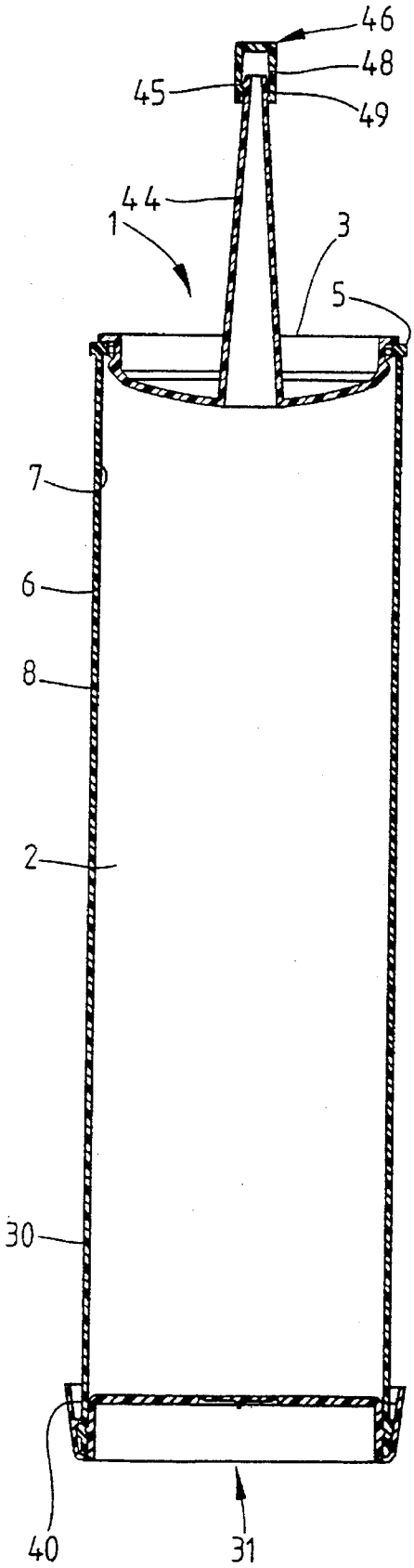
FIG. 10 is a diametrical axial sectional view of a container according to FIG. 9, FIGS. 11–13 show the cap according to FIG. 14 seen from below, from the side and in a perspective view from above.

The cap 3 shown in FIGS. 2 and 3 by way of two different embodiments is shown, in FIGS. 9 and 10, in a third, preferred embodiment. The ring part or flange 16 of cap 3 does preferably not project radially beyond tube flange 10 but terminates somewhat before reaching the latter's outer edge.

FIGS. 12 and 15 reveal clearly, how the bulge 24 projects from the lateral wall of the cap. Beyond the bulge, the cap begins two incline obliquely inwardly for connecting to a bowl-like bottom 19. Within the region for such a cap, tube 2 is either shaped to follow the outside of the cap corresponding to the shape of tube end 50 or is shaped as shown in FIGS. 10 and 14. This shape prevents the contents of the cartridge from being spilt and keeps the cap securely fixed. The attachment of the cap is facilitated and its unintended removal is counteracted in that the bulge downwardly forms a longer bevel with a minor angle, e.g. 30°–45°, in relation to lateral wall 17, while the remainder upwardly is rounded at a minor radius with an angle of e.g. 45°–90° close to the sidewall.

FIG. 13 shows the cap seen obliquely from above disclosing an almost triangular gripping handle 52, which is intended to facilitate removal of the cap. The gripping handle is shaped in one piece with the cap and is connected to a spot-like region uppermost at sidewall 17 via a small tongue 53 forming a transition into the upper inside of the flange of the cap. The wide upper flange prevents the cap from being pushed into the tube. The cap is preferably manufactured as one homogeneous piece, e.g. by injection molding, preferably of PVC.

A combination of FIGS. 13 and 4 makes obvious that, when pulling the handle 52 thanks to the latter's position within the upper cavity 54 of the cap and the spotlike connection to side wall 17, the applied pulling force will have a direction substantially in line with the upper curving of bulge 23. Consequently, an initial spot-like removal of the bulge and of the cap from the interior groove 51 of the tube are facilitated, which spot-like "cracking" of the connection cap/tube then will continue fast along the entire interior groove, until the cap is totally removed. If the cap is provided with a spout, a handle is preferably omitted.

A cap 3 is, however, suitably provided at a container end according to FIGS. 2, 3 or preferably uppermost in FIGS. 1, 6, 7 and 8 where, like in FIG. 4, the profile of this tube end is shown clearly. This profile shows parts 6–15 and 18 similar to corresponding parts in FIGS. 2 and 3. The extension of interior flange 9 inwardly may, however, be less, while the undercut surface 13 may be more vigorously shaped by an acute angle of e.g. app. 30° in relation to a radial plane.

The ring edge 18 is shaped as a pointed lip, which projects obliquely downwardly and inwardly from surface 12 and includes with its upper side 55 an angle of 100°–160°, preferably app. 140°, while the radial length from surface 12 in a practical example may be 0.5–5 mm, preferably app. 1 mm. FIG. 4 shows clearly, how lip 18 with its edge enters into the angled region between wall 17 and bulge 24 of the cap. The lip, which is flexible at least thanks to its shape, will thereby easily follow certain deviations and movements and accordingly will easily compensate for e.g. material shrinking, even in combination with the cap. The lip contributes even to pressing and keeping the cap in place and increases the efficiency of such a sealing arrangement both at arising interior pressures with expansion of the cap bottom in accordance with previous description and initially, when removing the cap, by elastically following all movements. The lip enters even thanks to its pointed shape somewhat into the cap material and increases the sealing effect even more. By showing a bevel 56 uppermost in the transitional region between surfaces 5 and 12, the profile facilitates insertion of particularly a cap 3, particularly in combination with a cap bottom bevel 25.

The invention is not limited to the embodiments shown and described hereinbefore, which may be modified and completed within the framework of the inventive idea and following claims.

We claim:

1. A container (1) in combination with a cap (3) for sealing off at least one end (4) of the container containing at least one of a viscous substance, a paste-like substance, a lubricant, silicon, and a food substance comprising:

a container (1) comprising a generally cylindrical tube (2) having a radially extending end flange (5) on a first end (4) thereof, the end flange (5) extending radially inwardly from an interior cylindrical surface (7) of the tube (2), forming an interior flange (9) having a radially extending delimitation surface (11) defining a free radially extending end surface of said first tube end (4);

a cap (3) comprising a bottom (19) located in the first tube end (4); and an interior ring part (17) extending substantially axially from an outer periphery of the bottom (19) terminating in a radially outwardly extending annular ring part (16) that abuts against the end surface of the first tube end (4);

wherein a side of the interior flange (9) facing a second end of the tube, remote from the first tube end (4), is terminated by an undercut surface (13) that is one of straight and concave to form a pointed annular edge (18) on the radially inner edge of the interior flange (9) facing the second tube end to create an enhanced sealing effect between the tube (2) and the cap (3).

2. A container and cap combination according to claim 1, wherein the end flange (5) extends radially outwardly from an exterior cylindrical surface (8) of a tube wall (6) to form an exterior flange (10).

3. A container and cap combination according to claim 2, wherein the interior flange (9) and the exterior flange (10) have a common upper delimitation surface (11) forming a free radially extending end surface of the first tube end (4).

4. A container and cap combination according to claim 2, wherein an axial end of the exterior flange (10), remote from said delimitation surface (11) terminates in a radially extending shoulder (15).

5. A container and cap combination according to claim 1, wherein the bottom of the cap (3) is a flexible bowl-like bottom (19), the convex side of which faces the interior of the tube (2) such that upon at least one of an increased interior pressure and a decreased exterior pressure the bowl-like bottom (19) assumes a flatter shape with a corresponding circumferential expansion of said interior ring part (17) which increases the sealing effect between the cap (3) and the tube (2).

6. A container and cap combination according to claim 1, wherein the undercut surface (13) and an adjoining inner peripheral surface (12) of the interior flange (9) form an angle from about 30° to about 85°.

7. A container and cap combination according to claim 1, wherein the undercut surface (13) and an adjoining inner peripheral surface (12) of the interior flange (9) form an angle of about 70°.

8. A container and cap combination according to claim 1, wherein the undercut surface (13) and an adjoining inner peripheral surface (12) of the interior flange (9) form an angle other than 90°.

9. A container and cap combination according to claim 8, wherein the undercut surface (13) and an adjoining inner peripheral surface (12) of the interior flange (9) form an angle from about 95° to about 130°.

10. A container and cap combination according to claim 1, wherein the undercut surface (13) and an adjoining inner peripheral surface (12) of the interior flange (9) form an angle of about 110°.

11. A container and cap combination according to claim 1, wherein an inner peripheral edge of the first tube end (4), between said delimitation surface (11) and an inner peripheral surface (12) of the interior flange (9), is beveled (56) to facilitate insertion of the cap (3) into the first tube end (4).

12. A container and cap combination according to claim 1, wherein the pointed annular edge (18) is shaped as a pointed lip (13, 18, 55) that projects obliquely axially toward the second tube end and radially inwardly from the interior flange (9), a radially inner side (55) of the pointed lip and an inner peripheral surface (12) of the interior flange (9) form an included angle of from about 100° to about 160°, the radial length of the pointed lip, measured from the inner peripheral surface (12) of the interior flange (9), is from about 0.05 to about 5 mm, and the pointed lip is flexible to follow any deviations and movements, whereby the pointed lip, due to its pointed shape, partially enters the material of the cap, providing an enhanced sealing effect between the cap and the tube.

13. A container and cap combination according to claim 12, wherein said radially inner side (55) of the pointed lip and said inner peripheral surface (12) of the interior flange (9) form an included angle of about 140°.

14. A container and cap combination according to claim 2, wherein the cap (3) is designed shape-complementary with said tube end (4), the interior ring part (17) is substantially cylindrical and the bottom (19), when viewed from outside, is slightly concave, an exterior ring part (20) extends axially from an outer peripheral edge of the annular ring part (16) toward the second tube end, the annular ring part (16) and the exterior ring part (20) define an annular groove (21) facing the second tube end, the first tube end (4) being received in the annular groove (21), a circumferential bulge (24) extends from the outer peripheral surface of the interior ring part (17) into the annular groove (21) and a circumferential protrusion (28) extends from the inner peripheral surface of the exterior ring part (20) into the annular groove (21), such that the bulge (24) and the protrusion (28) engage a side of the pointed annular edge (18) and the exterior flange (10), respectively, to arrest the first tube end (4) in the annular groove (21), the free axial half (27) of the annular part (20) is one of somewhat bent outwardly and provided with a circumferential interior bevel (29) to facilitate insertion of the cap (3) into the first tube end (4).

15. A container and cap combination according to claim 2, wherein the interior flange (9) projects inwardly from the interior cylindrical surface (7) farther than the exterior flange (10) extends outwardly from the exterior cylindrical surface (8), whereby said cap (3) is retained by the interior flange (9) with greater force than by the exterior flange (10).

16. A container and cap combination according to claim 1, wherein a portion of the interior ring part (17) adjacent the bottom (19) is provided with a bevel (25) to facilitate insertion of the cap (3) into the first tube end (4).

17. A container and cap combination according to claim 14, wherein the bulge (24) projects from the outer peripheral surface of the interior ring part (17), and the outer peripheral surface of the interior ring part (17) is obliquely inclined radially inwardly from the bulge (24) toward the bottom (19) forming a bevel (25) to facilitate insertion of the cap (3) into the first tube end (4).

18. A container and cap combination according to claim 14, wherein a side of the bulge (24) facing the second tube end is bevelled (25), forming an angle from about 30° to about 45° in relation to the outer peripheral surface of the interior ring part (17), while a side of the bulge (24) facing the first tube end (4) is more acutely rounded forming an angle of from about 45° to about 90° in relation to the outer peripheral surface of the interior ring part (17).

19. A container and cap combination according to claim 1, wherein the interior ring part (17) and the bottom (19) define a recessed cavity (54) in a side of the cap (3) remote from the second tube end, and a triangular gripping handle (52), designed as a single unitary piece with the cap (3), is located in the recessed cavity (54) and is connected to an axially outermost portion of the inner peripheral surface of the interior ring part (17) via a small tongue (53).

20. A container and cap combination according to claim 1, wherein the bottom (19) is provided with a spout (44) that converges conically outwardly, an external annular bulge (45) surrounding a free end of the spout (44), a small cap (46) with a bottom (47), a cylindrical sleeve wall (48) extending from the outer periphery of the bottom (47), and an interior circumferential bulge (49) on the inner peripheral surface of the sleeve wall (48) that is sized and shaped to snap over the external annular bulge (45) on the spout (44) in an interference fit for mounting the small cap (46) to the free end of the spout (44) and sealing the spout (44).

* * * * *